US008849175B2

(12) United States Patent
Miwa

(10) Patent No.: US 8,849,175 B2
(45) Date of Patent: Sep. 30, 2014

(54) IMAGE FORMING APPARATUS

(75) Inventor: Atsushi Miwa, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 535 days.

(21) Appl. No.: 13/053,720

(22) Filed: Mar. 22, 2011

(65) Prior Publication Data

US 2011/0236096 A1 Sep. 29, 2011

(30) Foreign Application Priority Data

Mar. 23, 2010 (JP) ..... 2010-066693

(51) Int. Cl.
*G03G 15/00* (2006.01)
*G03G 15/23* (2006.01)

(52) U.S. Cl.
CPC ..... *G03G 15/234* (2013.01); *G03G 15/6579* (2013.01); *G03G 2215/00586* (2013.01); *G03G 2215/0043* (2013.01)
USPC ..... 399/364; 399/401; 271/301

(58) Field of Classification Search
CPC ..... G03G 15/234
USPC ..... 399/364, 401; 271/301
See application file for complete search history.

(56) References Cited

U.S. PATENT DOCUMENTS

| | | | | |
|---|---|---|---|---|
| 5,327,206 | A * | 7/1994 | Ueda et al. | 399/402 |
| 5,332,205 | A * | 7/1994 | Chung et al. | 271/6 |
| 5,857,137 | A * | 1/1999 | Sakata et al. | 399/402 |
| 7,168,701 | B2 * | 1/2007 | Isaka et al. | 271/273 |
| 8,200,141 | B2 * | 6/2012 | Matsushima et al. | 399/381 |
| 2004/0234161 | A1 * | 11/2004 | Sugimoto | 382/266 |
| 2010/0158596 | A1 * | 6/2010 | Inoue | 399/401 |

FOREIGN PATENT DOCUMENTS

| | | |
|---|---|---|
| JP | 11-236172 | 8/1999 |
| JP | 2001264953 A | 9/2001 |
| JP | 2002-137873 | 5/2002 |
| JP | 2005-089073 | 4/2005 |
| JP | 2006-062809 | 3/2006 |
| JP | 2007-022687 | 2/2007 |
| JP | 2007-055815 | 3/2007 |
| JP | 2009-179411 | 8/2009 |

OTHER PUBLICATIONS

Notice of Reasons for Rejection for Japanese patent application No. 2010-066693 mailed Jan. 10, 2012.
Notification of First Office Action issued in corresponding Chinese Patent Application No. 201110068117.X dated Jul. 2, 2013.

(Continued)

*Primary Examiner* — Matthew G Marini
*Assistant Examiner* — Allister Primo
(74) *Attorney, Agent, or Firm* — Banner & Witcoff, Ltd.

(57) ABSTRACT

An image forming apparatus includes an apparatus body, an image forming unit, and a retransporting unit. The retransporting unit includes a transporting roller for applying a transporting force to the sheet and an input portion disposed at a position shifted upstream of the transporting roller in a retransporting direction. The input portion is configured to receive an input of a drive force supplied from the apparatus body. The retransporting unit further includes a drive shaft extending in a retransporting direction. The drive shaft is configured to transmit the drive force from the input portion toward the transporting roller by rotating about an axis thereof. A height of the image forming apparatus may be reduced by this configuration.

6 Claims, 8 Drawing Sheets

(56) References Cited

OTHER PUBLICATIONS

Office Action issued on corresponding Chinese Patent Application No. 201110068117.X mailed Feb. 28, 2014.

Notice of Reasons for Rejection for Japanese patent application No. 2010-066693 mailed Mar. 27, 2012.

Extended European Search Report received in corresponding European Patent Application No. 11002313.2 dated Aug. 1, 2012.

* cited by examiner

IMAGE FORMING APPARATUS

CROSS REFERENCE TO RELATED APPLICATION

The present application claims priority from Japanese Patent Application No. 2010-066693, which was filed on Mar. 23, 2010, the disclosure of which is incorporated herein by reference in its entirety.

BACKGROUND

1. Technical Field

The present invention relates to an image forming apparatus having a duplex-printing mechanism.

2. Related Art

The image forming apparatus having a duplex-printing mechanism generally includes an image forming unit configured to form an image on a sheet such as a paper, a switchback mechanism configured to switchback the sheet discharged from the image forming unit, and a retransporting unit configured to transport the sheet switched back by the switchback mechanism toward an inlet port of the image forming unit.

A known retransporting unit includes a first transporting roller and a second transporting roller arranged along the direction of transport of the sheet, and a belt configured to be entrained about a rotating shaft of the first transporting roller and a rotating shaft of the second transporting roller to transmit a drive force from the first transporting roller to the second transporting roller.

In the case of the image forming apparatus having a duplex-printing capability, a retransporting unit is needed to be provided. Therefore, the height of the image forming apparatus becomes great.

SUMMARY

A need has arisen to provide an image forming apparatus which has a duplex-printing mechanism and may has a reduced height.

According to an embodiment of the invention, an image forming apparatus includes an apparatus body and an image forming unit provided on the apparatus body and configured to form an image on a sheet. The image forming apparatus further includes a guide unit provided in the apparatus body and a retransporting unit which is detachably inserted and mounted in the apparatus body by being guided by the guide unit. The retransporting unit includes a transporting roller for applying a transporting force to the sheet transported in the retransporting path and an input portion disposed at a position shifted from the transporting roller in a direction opposite to a direction of insertion of the retransporting unit. The input portion is configured to receive an input of a drive force supplied from the apparatus body. The retransporting unit further includes a drive shaft extending from the input portion toward the transporting roller in the direction parallel to the direction of the insertion. The drive shaft is configured to transmit the drive force from the input portion toward the transporting roller by rotating about an axis thereof.

According to an embodiment of the invention, an image forming apparatus includes an apparatus body and further includes an image forming unit disposed in the apparatus body and configured to form an image on a sheet. The image forming apparatus still further includes a drive mechanism disposed in the apparatus body and a retransporting unit disposed in the apparatus body. The retransporting unit has a retransporting path along which the sheet discharged from the image forming unit is transported toward an inlet port of the image forming unit. The retransporting unit includes a transporting roller configured to transport the sheet transported in the retransporting path and further includes an input portion disposed at a position upstream of the transporting roller in a retransporting direction in which the retransporting unit retransports the sheet. The input portion is configured to receive a drive force transmitted from the drive mechanism. The retransporting unit still further includes a drive shaft extending in the retransporting direction. The drive shaft is configured to transmit the drive force, which is transmitted from the input portion, toward the transporting roller by rotating about an axis extending in the retransporting direction.

BRIEF DESCRIPTION OF THE DRAWINGS

For a more complete understanding of embodiments of the present invention, the needs satisfied thereby, and the features and advantages thereof, reference now is made to the following descriptions taken in connection with the accompanying drawings wherein.

DESCRIPTION OF PREFERRED EMBODIMENTS

Embodiments of the invention and their features and advantages may be understood by referring to FIGS. 1-8, like numerals being used for like corresponding parts in the various drawings.

In an embodiment shown below, an image forming apparatus according to the invention is applied to an electrophotographic image forming apparatus (a laser printer) having a duplex-printing mechanism and the embodiment of the invention will be described in conjunction with drawing below.

1. General Configuration of Image Forming Apparatus

Figure 1:
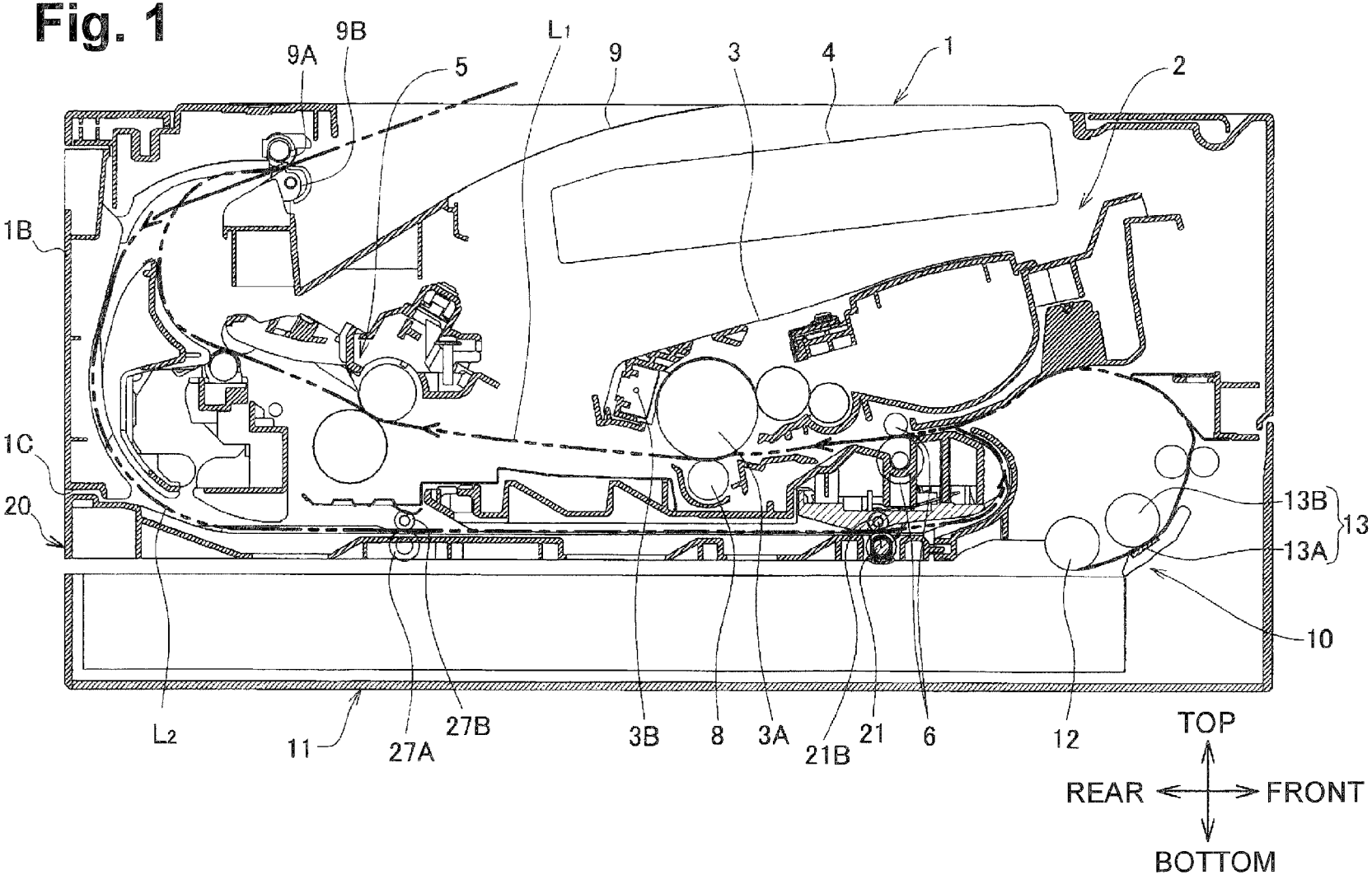
FIG. 1 is a cross-sectional view taken along a center of an image forming apparatus.

An image forming apparatus 1 includes an image forming unit 2, a paper feed device 10, and a retransporting unit (a DX unit) 20 as shown in FIG. 1. The image forming unit 2 is an image forming unit configured to form (print) an image on a paper or an OHP sheet (hereinafter, referred to as "paper"), the paper feed device 10 is a paper feeding unit configured to feed the paper to the image forming unit 2, and the retransporting unit 20 is a retransporting unit for retransporting the paper discharged from the image forming unit 2 toward an inlet port of the image forming unit 2.

The image forming unit 2 according to the embodiment is configured with an electrophotographic-type image forming unit including a process cartridge 3, an exposing unit 4 and a fixing unit 5. Stored in the process cartridge 3 are a photosensitive drum 3A configured to carry a developer image, and a charger 3B configured to charge the photosensitive drum 3A.

Then, the paper transported from the paper feed device 10 toward the image forming unit 2 is transported to a pair of registration rollers 6 and is transported to the photosensitive drum 3A after having corrected in skew by the pair of registration rollers 6.

In contrast, the charged photosensitive drum 3A is exposed by the exposing unit 4. After having formed a static latent image on the peripheral surface thereof, the developer (powdered toner in the embodiment) is supplied to the photosensitive drum 3A, so that the developer image is carried (formed) on the outer peripheral surface of the photosensitive drum 3A.

An electric charge having an opposite polarity from that of the developer is applied to a transfer roller 8 disposed on the opposite side of the photosensitive drum 3A with respect to the transported paper, and the developer image carried on the photosensitive drum 3A is transferred to the paper by the transfer roller 8.

The fixing unit 5 fixes the developer transferred to the paper to the paper by heating the paper after having transferred the developer image. The paper discharged from the fixing unit 5 and having formed with the image is redirected upward in the direction of transport while being transported on a transporting path L1 and then is discharged onto a paper discharge tray 9 provided on the side of an upper end surface of the image forming apparatus 1.

A discharge roller 9A is configured to apply a transporting force to the paper by rotating in a state of being in contact with the paper discarded from the fixing unit 5. The discharge roller 9A switches back the paper having completed image formation on the surface thereof and transports the paper toward a retransporting path L2 at the time of duplex printing which forms images on both the front and back surfaces of the paper. A pinch roller 9B is configured to press the paper against the discharge roller 9A and pinch the paper in cooperation with the discharge roller 9A.

The paper feed device 10 includes a paper feed tray 11 on which the papers to be transported to the image forming unit 2 are placed in a stacked manner, a pickup roller 12 configured to come into contact with the paper at the topmost position in the stacking direction from among the papers placed on the paper feed tray 11 and feed the topmost paper toward the image forming unit 2, and a separating mechanism 13 including a separating pad 13A and a separating roller 13B.

The separating mechanism 13 is a mechanism which separates the plurality of discharged papers and feeds the separated paper to the image forming unit 2 one by one by applying a transporting resistance by the separating pad 13A which comes into contact with the paper on one side from among the plurality of papers fed by the pickup roller 12 and simultaneously applying the transporting force by the separating roller 13B which comes into contact with the paper on the other side.

A rear cover 1B is an opening and closing unit configured to open part of the transporting path L1 and the retransporting unit 20 is inserted and mounted in an apparatus body 1A from a mounting port 1C provided between the rear cover 1B and the paper feed tray 11.

2. Configuration of Retransporting Unit

The retransporting unit 20 includes the retransporting path L2 for retransporting the paper discharged from the image forming unit 2 toward the inlet port of the image forming unit 2 (the registration rollers 6) as described above. The retransporting path L2 is a transporting path for retransporting the paper having completed the image formation on the surface thereof toward the inlet port of the image forming unit 2 when performing the duplex printing.

Figure 2:
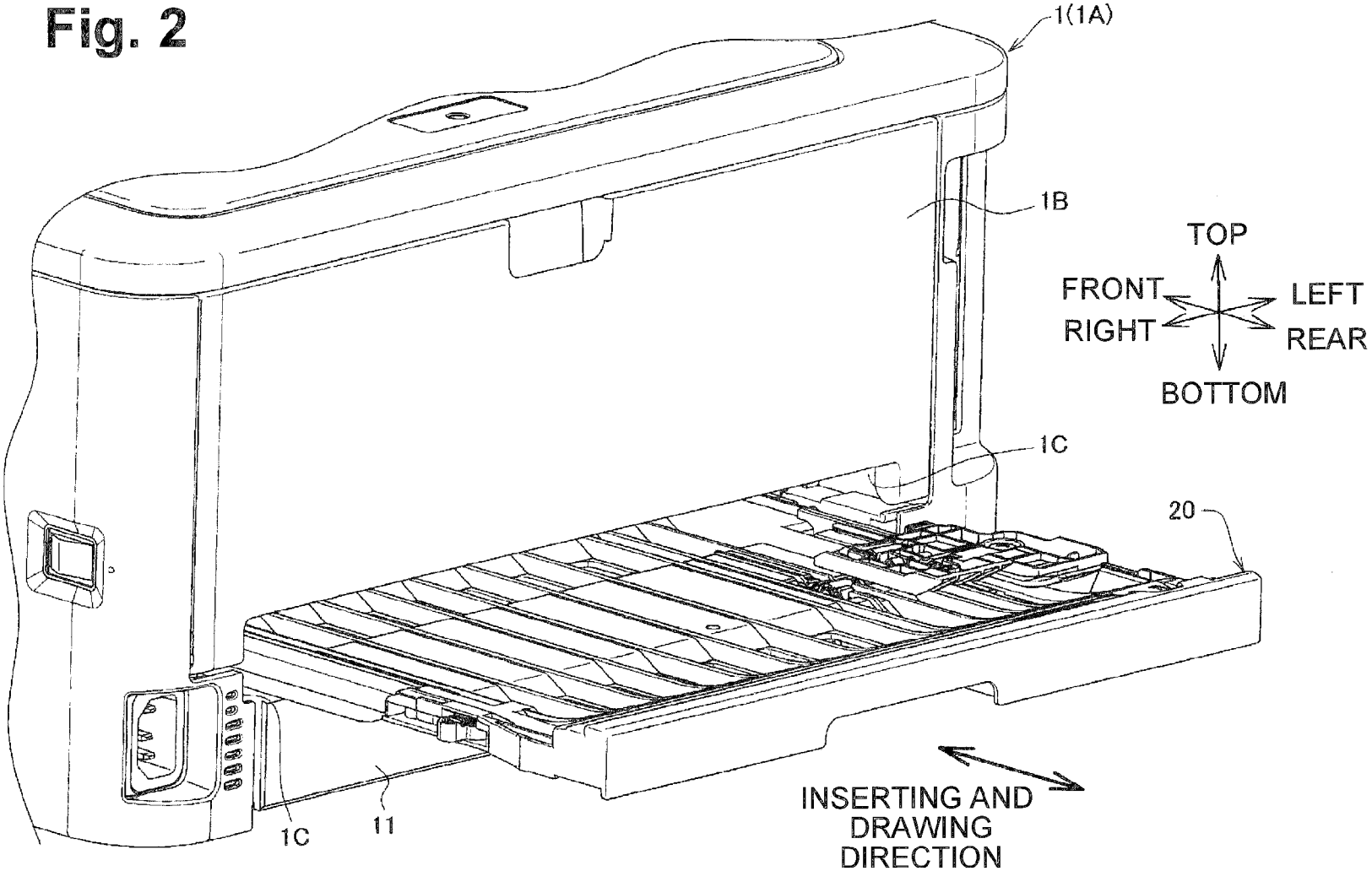
FIG. 2 is a drawing showing a state of mounting and demounting of a retransporting unit in the image forming apparatus.

The retransporting unit 20 is detachably inserted and mounted in the apparatus body 1A from the mounting port 1C as shown in FIG. 2. In the embodiment, the mounting direction (for example an inserting direction) and demounting direction (for example a drawing direction) of the retransporting unit 20 matches the direction of transport of the paper transported in there transporting path L2 (the retransporting unit 20) (the fore-and-aft direction in the embodiment).

The apparatus body 1A includes a housing or frame in which the image forming unit 2 is stored. Hereinafter, the direction of insertion and mounting of the retransporting unit 20 in the apparatus body 1A (the forward direction in the embodiment) is referred to as the direction of insertion.

Figure 3:
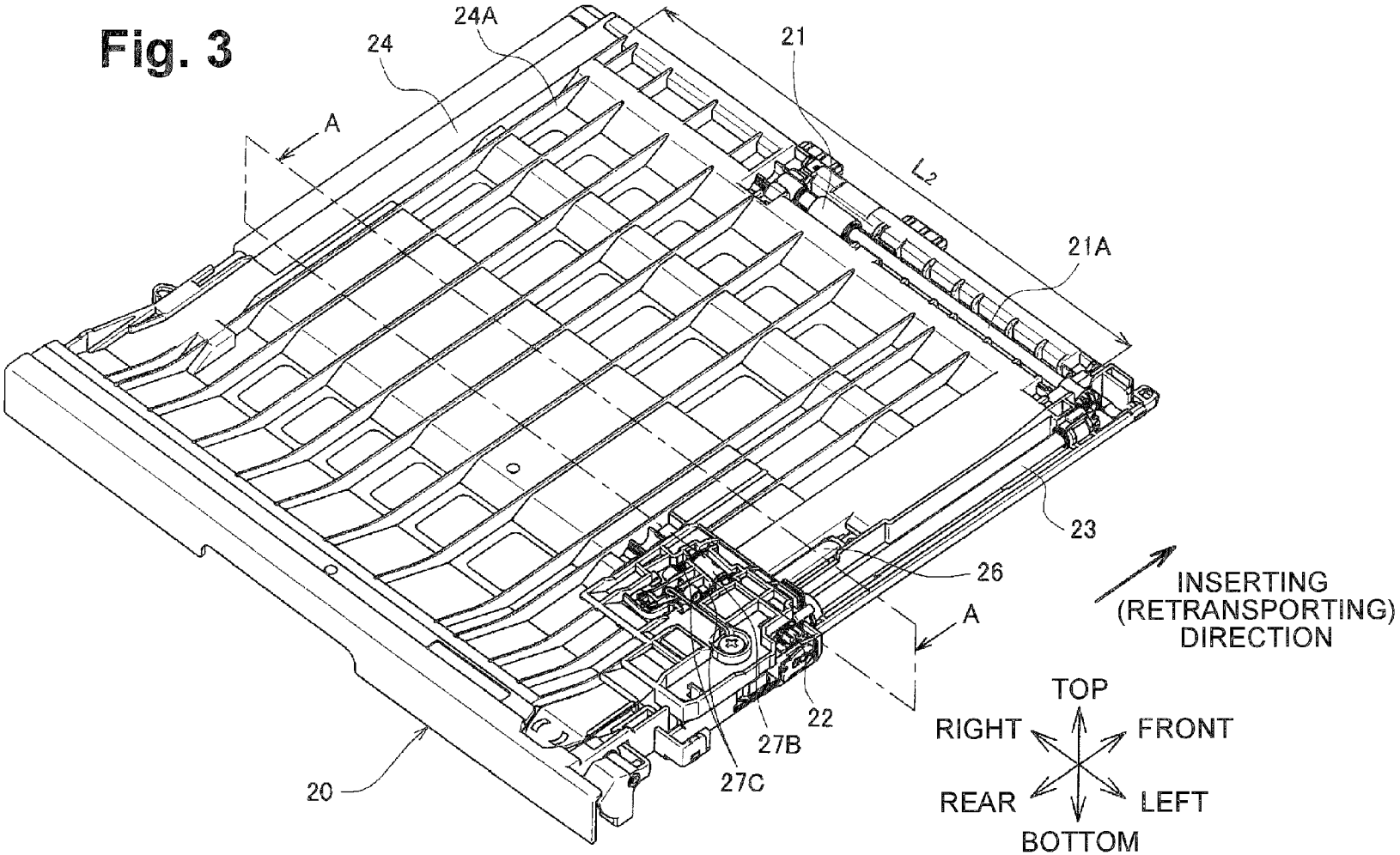
FIG. 3 is a perspective view of the retransporting unit.

As shown in FIG. 3, the retransporting unit 20 includes a transporting roller 21 configured to apply the transporting force on the paper transported through the retransporting path L2 (on the retransporting unit 20), an input gear 22 (an example of an input portion) configured to engage a drive gear 1D (an example of a drive mechanism) (shown in FIG. 4) provided on the apparatus body 1A, and a first drive shaft 23 configured to transmit a drive force supplied from the apparatus body 1A via the input gear 22 toward the transporting roller 21. Disposed in the apparatus body 1A at a position opposing the transporting roller 21 is a pinch roller 21B (shown in FIG. 1) configured to press the paper against the transporting roller 21.

Figure 4:
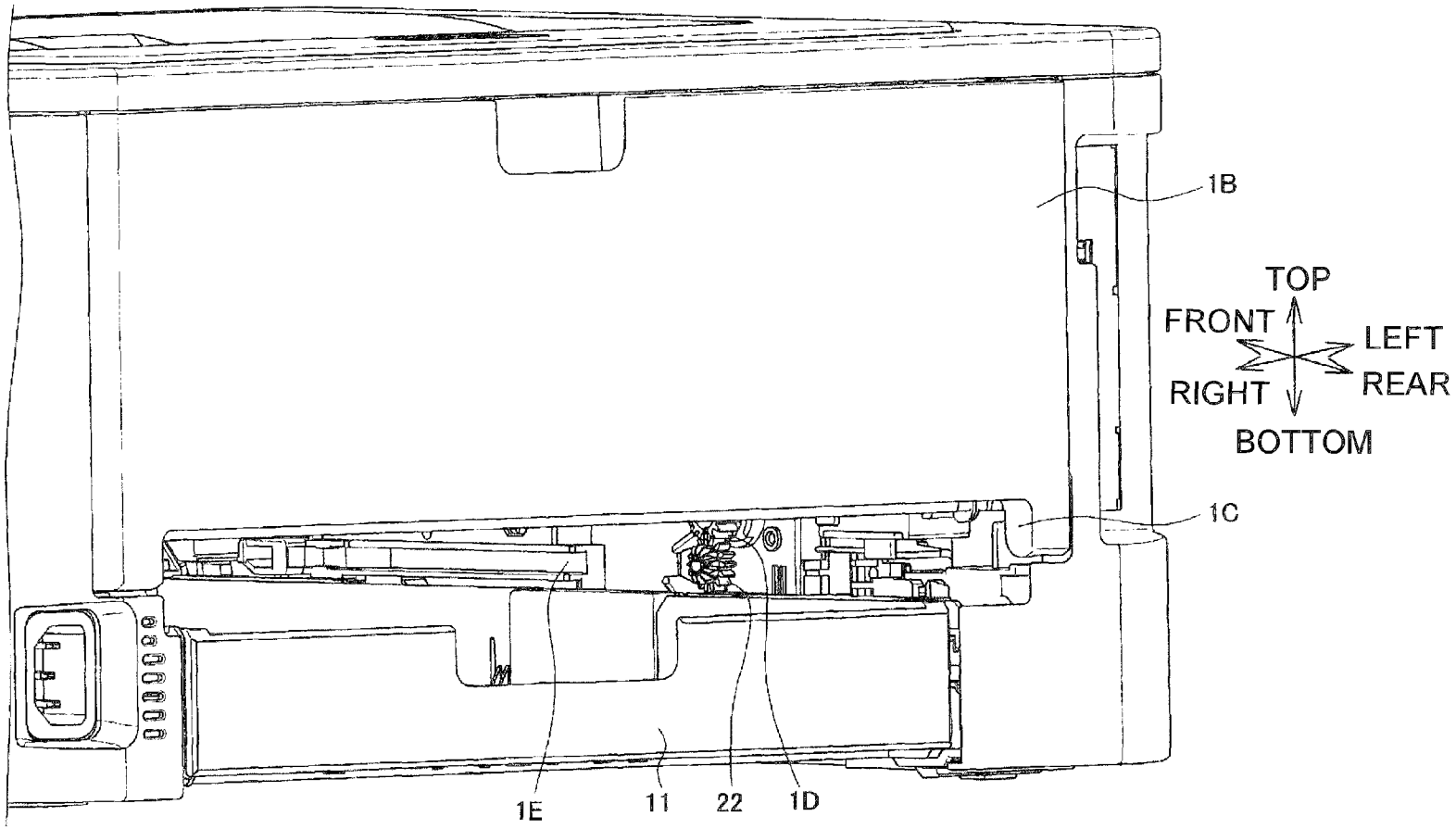
FIG. 4 is a perspective view of the image forming apparatus viewed from the side of a mounting port.

In FIG. 4, the input gear 22 is illustrated for easy understanding a relationship between the drive gear 1D and the input gear 22. However, since the input gear 22 is provided in the retransporting unit 20, the input gear 22 is not actually present in a state shown in FIG. 4 (a state in which the retransporting unit 20 is removed).

As shown in FIG. 3, a unit body 24 of the retransporting unit 20 is formed with a plurality of projecting ridges 24A extending in a band shape along the direction of paper transport, and the transport of paper is guided by the plurality of projecting ridges 24A.

The transporting roller 21 is assembled to the forward side in the direction of insertion (the front end side in FIG. 3) of the unit body 24 (the retransporting unit 20). In contrast, the input gear 22 is assembled to the unit body 24 at a position shifted in the backward side in the direction of insertion (the rear end side in FIG. 3) with respect to the transporting roller 21. In other words, the input gear 22 is disposed at a position upstream of the transporting roller 21 in a retransporting direction in which the sheet is transported.

The first drive shaft 23 is formed into a shaft shape extending in the direction parallel to the direction of insertion from the input gear 22 toward the transporting roller 21, and is configured to transmit the drive force from the input gear 22 toward the transporting roller 21 by rotating about an axis.

Figure 5:
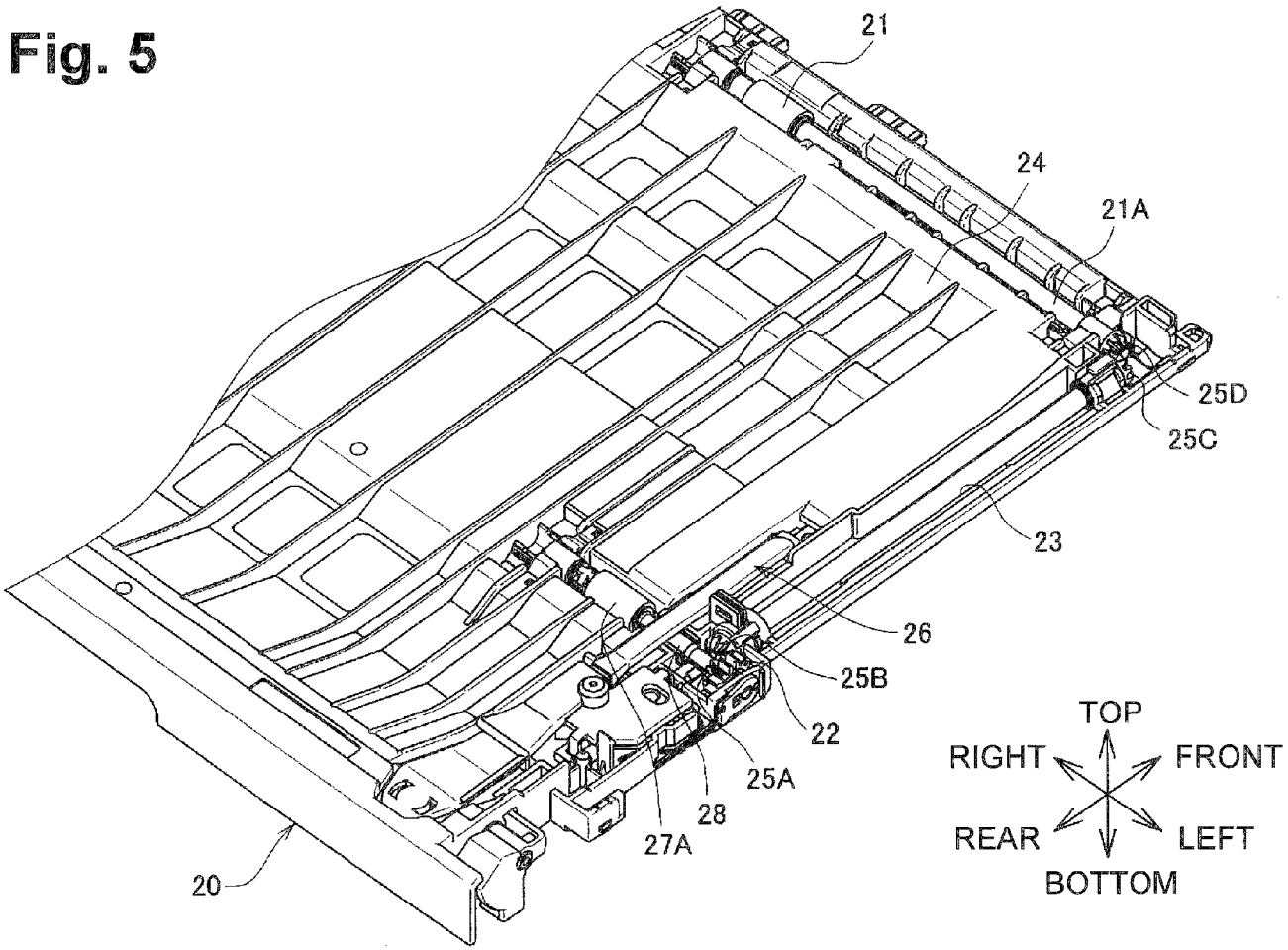
FIG. 5 is an enlarged perspective view showing a state in which a driven-side oblique feed roller is removed from the retransporting unit.

In the embodiment, transmission of the drive force from the input gear 22 to the first drive shaft 23 and the transmission of the drive force from the first drive shaft 23 to a drive shaft 21A of the transporting roller 21 are achieved via bevel gears 25A to 25D as shown in FIG. 5.

In other words, the bevel gear 25A is integrated with the input gear 22 (shown in FIG. 6), and the bevel gears 25B and 25C are integrated with shaft ends of the first drive shaft 23, respectively, and the bevel gear 25D are integrated to a shaft end of the drive shaft 21A.

Therefore, when the drive force is supplied from the drive gear 1D in a state in which the drive gear 1D and the input gear 22 are engaged, the drive force is transmitted to the first drive shaft 23 via the bevel gears 25A and 25B, and the drive force transmitted to the first drive shaft 23 is transmitted to the drive shaft 21A via the bevel gears 25C and 25D, so that the transporting roller 21 is rotated.

As shown in FIG. 3, the transporting roller 21 is disposed at a substantially center portion in the width direction in an area which constitutes the retransporting path L2. In contrast, the input gear 22 and the first drive shaft 23 are disposed at positions shifted in the width direction from the area which constitutes the retransporting path L2. The width direction corresponds to the direction orthogonal to the direction of transport and the thickness direction of the paper, and matches the lateral direction in the embodiment.

Figure 7:
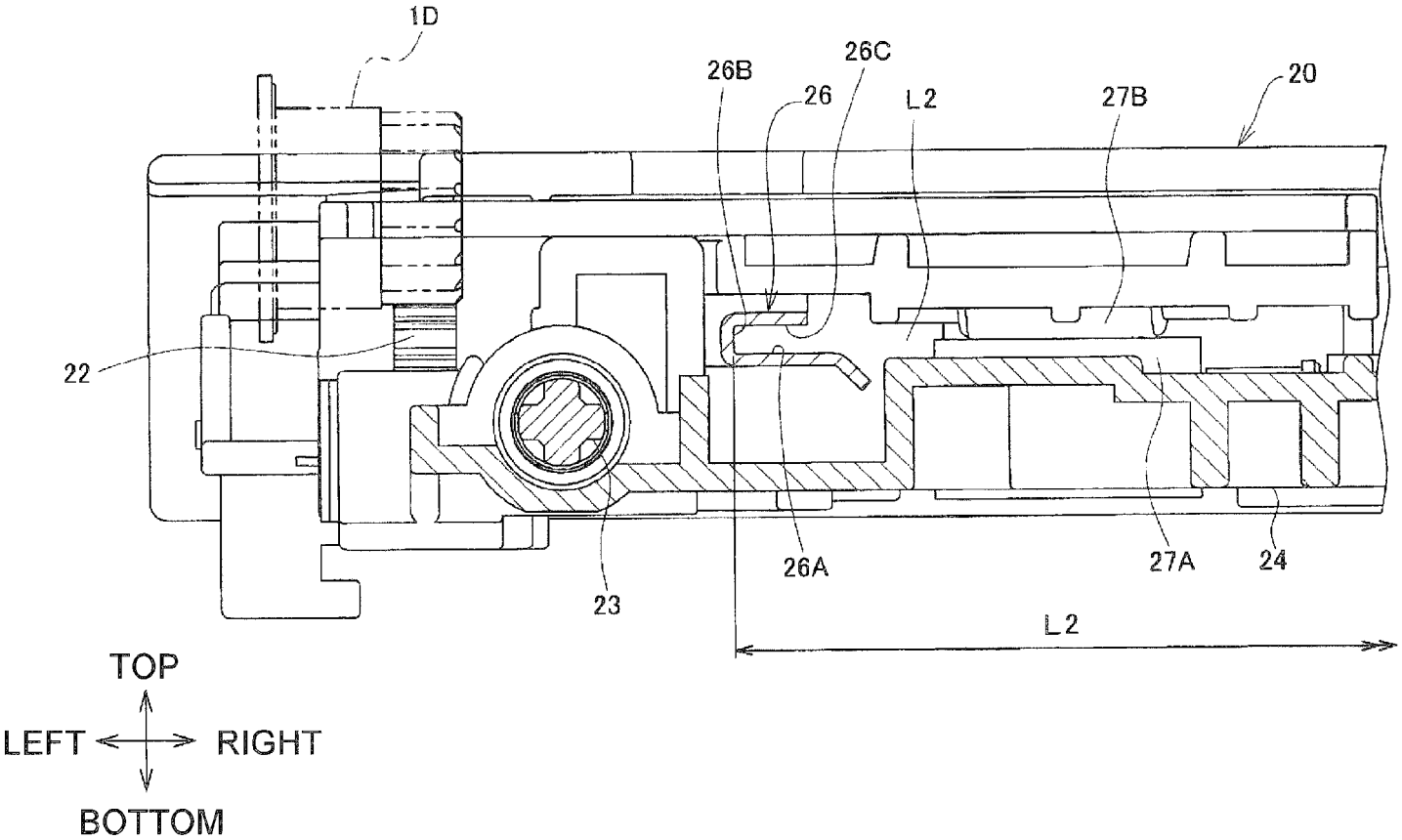
FIG. 7 is a cross-sectional view taken along the line A-A in FIG. 3.

As shown in FIG. 5, an oblique feed guide 26 extending in the direction of paper transport is assembled to the unit body 24 on one end side of the retransporting path L2 in the width direction so as to extend across a second drive shaft 28 which transmits the drive force to a drive-side oblique feed roller 27A, and the oblique feed guide 26 is formed to have an angular C-shape opened on the side of the retransporting path L2 in cross section orthogonal to the direction of transport as shown in FIG. 7.

Specifically, the oblique feed guide 26 includes a lower side guide surface 26A (an example of a first guide) facing the lower surface side of the paper transported through the retransporting path L2, a side edge guide surface 26B (an example of a second guide) provided at an end portion of the retransporting path L2 in the width direction so as to extend along the direction of paper transport, and an upper side guide surface 26C (an example of a third guide) facing the upper surface side of the paper transported through the retransporting path L2.

In other words, in the embodiment, the position of the end portion of the retransporting path L2 in the width direction is determined by the side edge guide surface 26B, and the first drive shaft 23 is disposed on the opposite side of the retransporting path L2 with respect to the side edge guide surface 26B.

As shown in FIG. 1, the drive-side oblique feed roller 27A is arranged on the upstream side of the transporting roller 21 in the direction of paper transport, and a driven-side oblique feed roller 27B is disposed at a position opposing the drive-side oblique feed roller 27A. Then, the transporting force to press one end portion of the paper in the width direction, which is transported by the cooperation of the drive-side oblique feed roller 27A and the driven-side oblique feed roller 27B, against the side edge guide surface 26B is applied to the paper.

Therefore, the transported paper moves toward the downstream side in the direction of transport while keeping the one end portion thereof in the width direction in contact with the side edge guide surface 26B. Therefore, if the paper is skewed with respect to the direction of transport, the skew is corrected.

A centerline of the rotating shaft of the driven-side oblique feed roller 27B is inclined with respect to the width direction as shown in FIG. 3, and a shaft end is pressed toward the drive-side oblique feed roller 27A by a resilient member such as a spring 27C. Therefore, the driven-side oblique feed roller 27B presses the paper against the drive-side oblique feed roller 27A while being rotated in conjunction with the movement of the paper.

Then, the apparatus body 1A is provided with guide rails 1E (an example of a guide unit) which come into contact with both end sides of the retransporting unit 20 in the width direction to guide the movement of the retransporting unit 20 when the retransporting unit 20 is inserted as shown in FIG. 4. The guide rails 1E are set on the forward side of the drive gear 1D in the direction of insertion of the retransporting unit 20 (the front side of the apparatus body 1A).

A pair of the guide rails 1E are configured to guide the movement of the retransporting unit 20 so as to hold end portions of the retransporting unit 20 in the width direction from above and below and are configured to have an angular C-shaped cross section in the direction orthogonal to the longitudinal direction thereof.

In a state in which the retransporting unit 20 is mounted in the apparatus body 1A and the drive gear 1D and the input gear 22 engage, since the input gear 22 is provided at the end portion of the retransporting unit 20 in the width direction, the input gear 22 is positioned on the opposite side from the retransporting path L2 with respect to the first drive shaft 23 as shown in FIG. 7.

FIG. 7 is a drawing showing a cross section (the cross section taken along the line A-A in FIG. 3) orthogonal to the first drive shaft 23. Therefore, the state shown in FIG. 7 is a drawing showing a state in which the retransporting path L2, the input gear 22, and the first drive shaft 23 are projected on an imaginary plane orthogonal to the direction of insertion.

Figure 6:
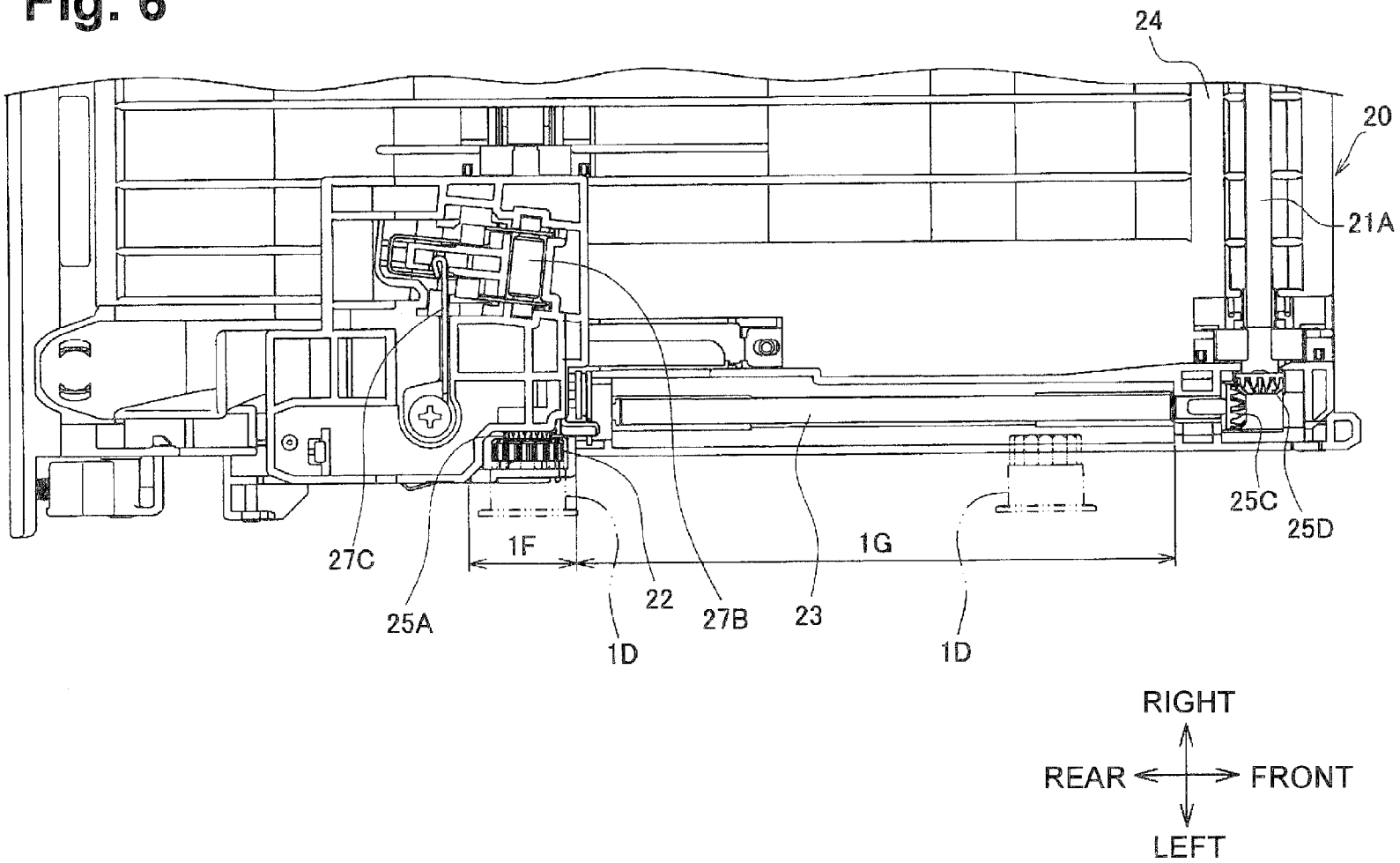
FIG. 6 is an enlarged front view showing a part of a first drive shaft in the retransporting unit in an enlarged scale.

When the retransporting unit 20 is viewed in the direction parallel to the direction of the thickness of the paper transported on the retransporting unit 20 (the vertical direction in the embodiment), the retransporting unit 20 has a shape such that an outer edge portion 1F of the retransporting unit 20 corresponding to the input gear 22 projects outward of the an outer edge portion 1G of the retransporting unit 20 corresponding to the first drive shaft 23 as shown in FIG. 6.

In other words, in the embodiment, the shape of the retransporting unit 20 on the side of the first drive shaft 23 has a shouldered shape (a stepped shape) as if the outer edge portion 1G corresponding to the first drive shaft 23 is notched. The term "outside of the retransporting unit 20" means the side shifted from the retransporting unit 20 toward the apparatus body 1A in the width direction, and is the left side of the retransporting unit 20 in FIG. 6.

Figure 8:
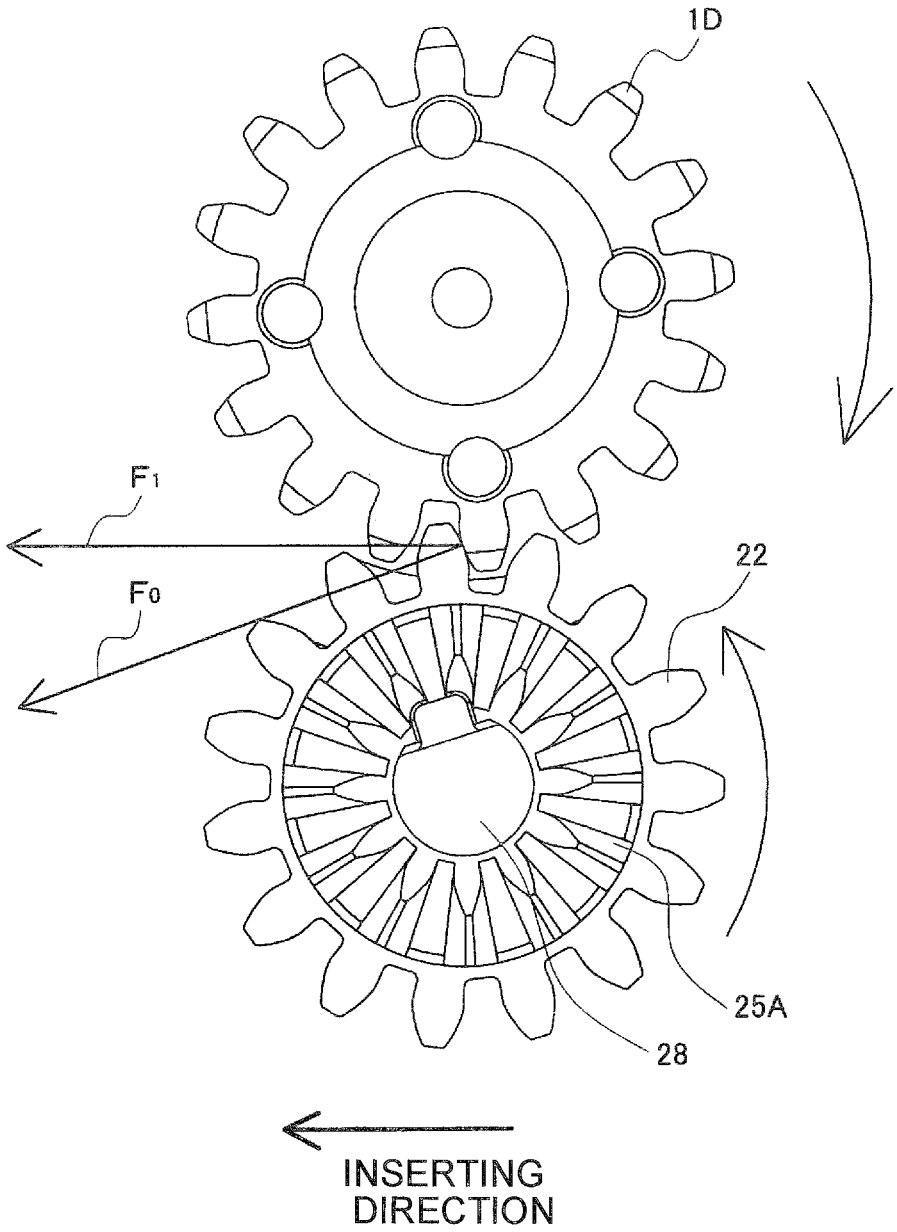
FIG. 8 is a drawing showing a state of engagement between the input gear and a drive gear.

In a state in which the input gear 22 and the drive gear 1D engage and hence the drive force is supplied from the drive gear 1D to the input gear 22, an engaging pressure Fo as shown in FIG. 8 acts on the input gear 22. In the embodiment, however, the positions and the directions of rotation of the input gear 22 and the drive gear 1D are set so as to cause a component force F1 in the direction toward the forward side in the direction of insertion to be generated in the engaging pressure Fo.

3. Characteristics of Image Forming Apparatus in the Embodiment

In the embodiment, the drive force is transmitted to the transporting roller 21 by the first drive shaft 23. Therefore, the height of the component portion required for transmitting the drive force is the diametric dimension of the first drive shaft 23, and the diametric dimension becomes sufficiently smaller than the case where the drive force is transmitted with the belt if the drive force to be transmitted is the same. Therefore, in the embodiment, the thickness of the retransporting unit 20 is reduced in comparison with the retransporting unit having configured to transmit the drive fore to the transporting roller 21 with the belt.

In the embodiment, since the guide rails 1E for guiding the movement of the retransporting unit 20 are provided, the contact portions between the retransporting unit 20 and the guide rails 1E increase as the insertion of the retransporting unit 20 proceeds, and hence the retransporting unit 20 is stabilized more. However, in the initial stage of the insertion, the contact portions between the retransporting unit 20 and the guide rails 1E are small, and hence the retransporting unit 20 is liable to be unstable.

Therefore, assuming that the input gear 22 is provided on the retransporting unit 20 at a position shifted on the forward side in the direction of insertion of the retransporting unit 20 with respect to the transporting roller 21, the input gear 22 enters into the apparatus body 1A in the initial state of insertion in which the retransporting unit 20 is still in the unstable state. Therefore, the input gear 22 collides with the apparatus body 1A, and hence the input gear 22 or the apparatus body 1A may become damaged.

In contrast, in the embodiment, since the input gear 22 is provided on the retransporting unit 20 at a position shifted on the backward side in the direction of insertion of the retransporting unit 20 with respect to the transporting roller 21, when the insertion of the retransporting unit 20 is proceeded to an extent in which the input gear 22 enters into the apparatus body 1A, the retransporting unit 20 is stabilized, and hence there is little probability of collision between the input gear 22 and the apparatus body 1A.

As described above, in the embodiment, the thickness of the retransporting unit 20 is reduced while restraining the possibility that the input gear 22 or the apparatus body 1A becomes damaged when the retransporting unit 20 is mounted in the apparatus body 1A, so that the downsizing of the image forming apparatus is achieved.

When it is assumed that the first drive shaft 23 is provided on the retransporting unit 20 at a portion corresponding to the area which constitutes the retransporting path L2, it is necessary to arrange the first drive shaft 23 at a position shifted from the retransporting path L2 in the vertical direction so as to avoid the interference between the first drive shaft 23 and the paper transported through the retransporting path L2. Therefore, further reduction of the thickness of the retransporting unit 20 becomes difficult.

In contrast, the embodiment is characterized in that the first drive shaft 23 is disposed on the retransporting unit 20 at a position shifted from the area which constitutes the retransporting path L2. Therefore, the thickness of the retransporting unit 20 is further downsized.

The embodiment is also characterized in that when the retransporting path L2, the input gear 22, and the first drive shaft 23 are projected on the imaginary plane orthogonal to the direction of insertion as shown in FIG. 7, the projected input gear 22 is positioned on the opposite side from the projected retransporting path L2 with respect to the projected first drive shaft 23.

Accordingly, in the embodiment, when inserting and mounting the retransporting unit 20 in the apparatus body 1A, the drive gear 1D is displaced on the backward side in the direction of insertion toward the input gear 22 relatively with the retransporting unit 20 as shown in FIG. 6.

However, since the projected input gear 22 is positioned on the opposite side from the projected retransporting path L2 with respect to the projected first drive shaft 23 as shown in FIG. 7, the interference between the drive gear 1D and the first drive shaft 23 is prevented when the drive gear 1D is displaced relatively with the retransporting unit 20.

The embodiment is characterized in that when the retransporting unit 20 is viewed in the direction parallel to the direction of the thickness of the paper transported on the retransporting unit 20, the outer edge portion 1F of the retransporting unit 20 corresponding to the input gear 22 projects outward of the outer edge portion 1G of the retransporting unit 20 corresponding to the first drive shaft 23.

Accordingly, in the embodiment, at least part of the drive gear 1D can be displaced relatively with the outside of the outer edge portion of the retransporting unit 20 when the drive gear 1D is displaced relatively with the retransporting unit 20. Therefore, interference between the drive gear 1D and the retransporting unit 20 can be prevented.

The embodiment is characterized in that the force F1 directed toward the forward side in the direction of insertion acts on the retransporting unit 20 via the input gear 22 as shown in FIG. 8 when the drive force is supplied from the apparatus body 1A to the input gear 22.

Accordingly, in the embodiment, displacement of the retransporting unit 20 on the backward side in the direction of insertion (the direction to move apart) is prevented when the drive force is transmitted to the transporting roller 21, and hence the retransporting unit 20 needs not to be firmly fixed to the apparatus body 1A. Therefore, the mounting and demounting workability of the retransporting unit 20 with respect to the apparatus body 1A is improved.

(Other Embodiments)

In the embodiment described above, the invention is applied to a monochrome-type image forming apparatus. However, the invention is not limited thereto, and may be applied to a color-type image forming apparatus.

In the embodiment described above, transmission of the drive force from the input gear 22 to the first drive shaft 23 and transmission of the drive force from the first drive shaft 23 to the drive shaft 21A of the transporting roller 21 are achieved via the bevel gears 25A to 25D. However, the invention is not limited thereto and, for example, a crown gear, a face gear, or universal joints may be used.

In the embodiment described above, the shape of the retransporting unit 20 on the side of the first drive shaft 23 has the shouldered shape (the stepped shape) as if the outer edge portion 1G corresponding to the first drive shaft 23 is notched. However, the invention is not limited thereto.

In the embodiment described above, the retransporting unit 20 is insertable in the retransporting direction. However, the invention is not limited thereto and, for example, retransporting unit 20 may be insertable in a direction orthogonal to the retransporting direction alternatively.

The invention must only conform to the scope of the invention described in Claims, and is not limited to the above-described embodiment.

What is claimed is:

1. An image forming apparatus having a duplex-printing mechanism, comprising:

an apparatus body;

an image forming unit disposed in the apparatus body and configured to form an image on a sheet;

a drive mechanism disposed in the apparatus body; and a retransporting unit disposed in the apparatus body and having a retransporting path along which the sheet discharged from the image forming unit is transported toward an inlet port of the image forming unit, and the retransporting unit including:

a transporting roller configured to transport the sheet transported in the retransporting path;

an input portion disposed at a position upstream of the transporting roller in a retransporting direction in which the retransporting unit retransports the sheet, and configured to receive a drive force transmitted from the drive mechanism;

a drive shaft extending in the retransporting direction, and configured to transmit the drive force, which is transmitted from the input portion, toward the transporting roller by rotating about an axis extending in the retransporting direction;

a first guide configured to guide a sheet being retransported by the retransporting unit; and a second guide configured to further guide a sheet being retransported by the retransporting unit, the second guide provided at an end portion of the retransporting path in a width direction and having a guide surface extending along a direction of transport of the sheet, wherein the drive shaft and the input portion are disposed on an opposite side from the retransporting path with respect to the guide surface of the second guide such that the input portion overlaps with the guide surface of the second guide when viewed along the width direction.

2. The image forming apparatus according to claim 1, wherein the retransporting unit is drawable from the apparatus body and insertable into the apparatus body.

3. The image forming apparatus according to claim 2, wherein the retransporting unit is insertable into the apparatus body in the retransporting direction.

4. The image forming apparatus according to claim 1, wherein the retransporting unit includes first bevel gears configured to transmit the drive force from the drive shaft to the transporting roller.

5. The image forming apparatus according to claim 4, wherein the retransporting unit further includes second bevel gears configured to transmit the drive force from the input portion to the drive shaft.

6. The image forming apparatus according to claim 1, wherein the input portion includes an input gear including a bevel gear portion configured to drive the drive shaft.

* * * * *